United States Patent [19]

Kato et al.

[11] Patent Number: 4,651,053

[45] Date of Patent: Mar. 17, 1987

[54] DISPLAY TUBE HAVING PRINTED COPOLYMER FILM LAYER

[75] Inventors: Hiroshi Kato, Kanagawa; Toshihisa Kojima, Saitama; Kazuo Yamazaki, Aichi, all of Japan

[73] Assignee: Sony Corporation, Tokyo, Japan

[21] Appl. No.: 686,460

[22] Filed: Dec. 26, 1984

[30] Foreign Application Priority Data

Dec. 28, 1983 [JP] Japan ..... 58-246657

[51] Int. Cl.[4] ..... H01J 29/28; B05D 5/06; B05D 5/12

[52] U.S. Cl. ..... 313/466; 313/473; 427/64; 427/68

[58] Field of Search ..... 313/466, 473; 427/64, 427/68, 385.5; 428/690, 691

[56] References Cited

U.S. PATENT DOCUMENTS 4,327,123 4/1982 Levine et al. ..... 427/68 X
4,423,128 12/1983 Koike et al. ..... 427/68 X
4,474,855 10/1984 Brixius et al. ..... 427/385.5 X

*Primary Examiner*—Palmer C. DeMeo
*Assistant Examiner*—Sandra L. O'Shea
*Attorney, Agent, or Firm*—Hill, Van Santen, Steadman & Simpson

[57] ABSTRACT

A display tube such as a cathode ray tube or fluorescent display tube which includes a film layer over the phosphor layer, and including a random copolymer with the following chemical structure:

wherein $R_1$, $R_3$ represent individually H or $CH_3$; $R_2$ is H; and X is OH. The layer can be formed over the phosphor layer uniformly and thinly by means of a printing process to thereby shorten the manufacturing process and reduce the cost of manufacture.

8 Claims, 1 Drawing Figure

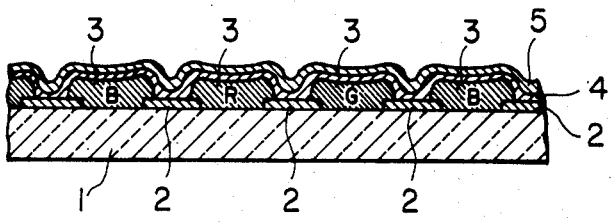
3
3
3
3
5
4
2
B
R
G
B
1
2
2
2

DISPLAY TUBE HAVING PRINTED COPOLYMER FILM LAYER

BACKGROUND OF THE INVENTION

1. Field of the Invention

The present invention is directed to a display tube and more specifically relates to a composition for a filming layer formed at the fluorescent surface of a display tube such as a cathode ray tube or a fluorescent display tube.

2. Description of the Prior Art

The fluorescent surface of a cathode ray tube generally comprises a layer coated with red, blue and green phosphor material deposited on a glass panel. Normally, a film layer is formed over the phosphor layer and then provided with a metal backing. However, the paste used in the phosphor layer through the normal printing process usually contains, as a binder, an acrylic or polyester resin which is soluble in an organic solvent and, accordingly, an aqueous emulsion lacquer or spray lacquer generally employed in cathode ray tubes or the like cannot be used for forming the material of the film over the phosphor layer since the phosphor layer repels water. In view of the foregoing, there has been proposed a method for forming a film layer in which the binder of the organic solvent type contained in the phosphor layer is removed by heat and thereafter, a thin aqueous layer is formed thereover. A solution of a resin dissolved in an organic solvent is spread as a thin film over the layer and then water is eliminated after hardening the film. However, this method has the disadvantage of increasing the number of steps and the cost of manufacture.

SUMMARY OF THE INVENTION

In accordance with the present invention, the foregoing problems are overcome and there is provided a display tube in which the film layer can be formed through the same printing method as used for the phosphor layer by improving the composition of the filming layer.

The improvements of the present invention can be attained by using a filming layer of a composition comprising a random copolymer having the following chemical structure:

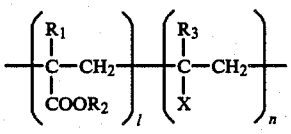

(made by Mitsui Toatsu Kagaku K.K.) where $R_1$ and $R_3$ represent respectively H or $CH_3$; $R_2$ represents H, and X represents OH. The ratio of 1 to n is in the range from about 0.1 to 1 to 10 to 1, and the random copolymer has an average molecular weight of at least 50,000. More preferably, the copolymer has an average molecular weight ranging from 200,000 to 500,000 and in the preferred embodiment of the invention has an average molecular weight in the range from 300,000 to 400,000.

The ends of the polymer can be terminated by $R_1$, $R_2$, $R_3$, or X. The preferred random copolymer is a copolymer of allyl alcohol and methyl-methacrylate.

The film is applied on the phosphor layer in the form of a paste usually containing a spreading agent in an amount of from 2 to 15% by weight of the total amount of paste. The paste can be coated on the phosphor layer by means of the usual screen printing process.

In accordance with the present invention, a uniform and thin filming layer can be formed in the same type of printing process as that used for the phosphor layer, whereby the number of production steps can be decreased and the production cost of the display tube can be reduced.

Other objects and features as well as advantages of the invention will become apparent from the succeeding description of the invention in conjunction with the accompanying drawing.

BRIEF DESCRIPTION OF THE DRAWING

The single FIGURE of the drawing is a greatly enlarged view in cross section of the display surface of a tube embodying the principles of the present invention.

DESCRIPTION OF THE PREFERRED EMBODIMENTS

In the present invention, there is provided a composition for a film layer used in a display tube, for example, a cathode ray tube or fluorescent display tube, which film comprises a random copolymer represented by the general formula:

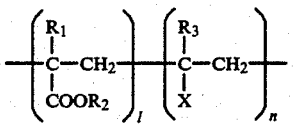

where $R_1$ and $R_3$ are individually either H or $CH_3$; $R_2$ is H; and X is OH, the ratio of 1 to n being in the range from 0.1 to 1 to 10 to 1.

The preferred copolymer of the present invention is a random copolymer of allyl alcohol and methyl-methacrylate having an average molecular weight of from 300,000 to 400,000 and represented by the general formula:

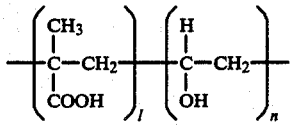

EXAMPLE

An example of the composition of the present invention in the form of a paste is given below:

Copolymer of allyl alcohol and methyl-methacrylate: 75 g;
Ethanol: 15 g;
Water: 150 g;
Aqueous ammonia: 5–15 ml.

A viscosity of the filming layer paste suitable for screen printing (50–200 ps) can be obtained by controlling the molecular weight of the copolymer, i.e., its degree of polymerization, to the aforementioned average molecular weight range of 300,000 to 400,000, and controlling the pH between 9 to 11 by the addition of aqueous ammonia.

It is also desirable to include a dispersing agent for controlling the spreadability and the penetration of the copolymer into the phosphor underlayer. For this purpose, it is recommended that 20 to 40 g of butyl carbitol or the like which can be employed as a solvent for the phosphor layer be added to the filming layer paste. The amount of agent added should be adjusted to a value of about 2 to 15% by weight based on the total amount of the filming layer paste.

A paste containing the foregoing copolymer as part of the composition can be coated on a phosphor layer formed, for example, through screen printing by means of the same printing procedures as described above. The filming layer paste does not interfere substantially with the phosphor layer, and evidences a satisfactory stretchability over the phosphor layer.

Turning to the drawing, there is shown a black pattern 2, formed on a flat transparent substrate 1, having phosphor layers 3 of different colors successively formed therebetween by means of screen printing. Then, a filming layer paste 4 comprising the improved composition of the present invention is coated on the phosphor layer 3 by way of a screen printing process. Then, a metal backing layer 5 composed of aluminum is formed through vapor deposition over the filming layer 4.

The display tube having the surface thus produced is incorporated into a display tube, for example, a cathode ray tube or fluorescent display tube after a baking step, and an exhaustion of gases.

Since a thin and uniform filming layer can be formed using a printing process according to the present invention, this manufacturing step can be shortened, and the manufacturing cost for the entire display tube can be decreased.

It should be evident that various modifications can be made to the described embodiments without departing from the scope of the present invention.

I claim as my invention:

1. A display tube including a phosphor layer, a printed film layer overlying said phosphor layer, and a metal backing layer overlying said film layer, said film layer containing a random copolymer having the following chemical structure:

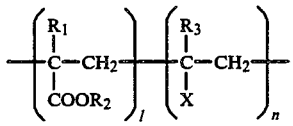

where $R_1$ and $R_3$ are individually either H or $CH_3$; $R_2$ is H and X is OH, the ratio of l to n being in the range from 0.1 to 1 to 10 to 1.

2. A tube according to claim 1 wherein said copolymer has an average molecular weight of at least 50,000.

3. A tube according to claim 1 wherein said copolymer has an average molecular weight in the range from 200,000 to 500,000.

4. A tube according to claim 2 wherein said average molecular weight is in the range from 300,000 to 400,000.

5. A display tube according to claim 1 wherein said film is in the form of a paste containing a spreading agent.

6. A display tube according to claim 5 wherein said spreading agent is present in an amount of from 2 to 5% by weight of the total amount of paste.

7. A display tube according to claim 5 wherein said paste is coated on said phosphor layer by means of a screen printing process.

8. A tube according to claim 1 wherein said copolymer in a copolymer of allyl alcohol and methylmethacrylate.

* * * * *